US010591246B2

(12) United States Patent
Lundbäck et al.

(10) Patent No.: US 10,591,246 B2
(45) Date of Patent: Mar. 17, 2020

(54) ADJUSTING DEVICE FOR AN ADJUSTABLE REST FOR A RIFLE STOCK

(71) Applicant: KALIX TEKNIK AB, Kalix (SE)

(72) Inventors: Magnus Lundbäck, Kalix (SE); David Henriksson, Kalix (SE); Andreas Forslund, Kalix (SE)

(73) Assignee: KALIX TEKNIK AB (SE)

( * ) Notice: Subject to any disclaimer, the term of this patent is extended or adjusted under 35 U.S.C. 154(b) by 0 days.

(21) Appl. No.: 16/079,774

(22) PCT Filed: Feb. 24, 2017

(86) PCT No.: PCT/EP2017/054405
§ 371 (c)(1),
(2) Date: Aug. 24, 2018

(87) PCT Pub. No.: WO2017/144701
PCT Pub. Date: Aug. 31, 2017

(65) Prior Publication Data

US 2019/0093984 A1 Mar. 28, 2019

(30) Foreign Application Priority Data

Feb. 26, 2016 (SE) ..... 1650257

(51) Int. Cl.
*F41C 23/14* (2006.01)

(52) U.S. Cl.
CPC ..... *F41C 23/14* (2013.01)

(58) Field of Classification Search
CPC ..... F41C 23/14
USPC ..... 42/71.01, 73
See application file for complete search history.

(56) References Cited

U.S. PATENT DOCUMENTS

| | | | | | |
|---|---|---|---|---|---|
| 2,956,343 | A * | 10/1960 | Shaffer | F41C 23/14 | 33/506 |
| 3,137,958 | A * | 6/1964 | Lewis | F41C 23/14 | 42/73 |
| 3,267,601 | A | 8/1966 | Roy | | |
| 4,422,256 | A * | 12/1983 | Maucher | F41C 23/14 | 42/73 |
| 5,235,764 | A * | 8/1993 | Perazzi | F41C 23/14 | 42/1.01 |
| 2019/0093984 | A1 * | 3/2019 | Lundback | F41C 23/14 | |

OTHER PUBLICATIONS

International Search Report dated Mar. 28, 2017; International Patent Application No. PCT/EP2017/054405 filed Feb. 24, 2017; ISA/EP.

* cited by examiner

*Primary Examiner* — Samir Abdosh
(74) *Attorney, Agent, or Firm* — McDonald Hopkins LLC

(57) ABSTRACT

Adjusting device (1) for an adjustable rest (2, 2*a*, 2*b*) for a rifle stock (3), comprising: a first portion (4) adapted to be fixedly arranged to the rifle stock (3), an adjusting portion (5) adapted to be releasably engaged with the first portion (4) and movable between an engaged, locking position and a disengaged, release position upon actuation of the adjusting portion (5), wherein the adjusting portion (5) is adjustable in relation to the first portion (4) in a release position, and wherein the adjusting portion is locked in relation to the first portion (4) in the locking position, wherein the adjusting portion (5) is adapted to be fixedly arranged to the adjustable rest (2, 2*a*, 2*b*).

18 Claims, 7 Drawing Sheets

ADJUSTING DEVICE FOR AN ADJUSTABLE REST FOR A RIFLE STOCK

CROSS-REFERENCE TO RELATED APPLICATION

This application is a 35 U.S.C. § 371 national stage filing of PCT Application No. PCT/EP2017/054405 filed on Feb. 24, 2017, entitled "ADJUSTING DEVICE FOR AN ADJUSTABLE REST FOR A RIFLE STOCK," which claims priority to Swedish Patent Application No. 1650257-7, filed Feb. 26, 2016, each of which are incorporated herein in their entirety by reference.

TECHNICAL FIELD

The present invention relates generally to an adjusting device for an adjustable rest for a rifle stock.

BACKGROUND ART

It is known to use adjusting mechanisms for cheek rests for rifle stocks that comprises a separate adjusting handle, button or knob for releasing and locking the cheek rest in relation to the rifle stock. Such adjusting knob is arranged on the side of the rifle stock and enters the interior and the locking portion of the cheek rest of the rifle stock via a hole in the side of the rifle stock.

A number of drawbacks exist with the known art. For instance, a separate adjusting knob is required which adds to the cost of the adjusting mechanism. Additionally, the work required to manufacture or retrofit an existing rifle including the preparation of a hole adds to the time and cost. Further a protruding adjusting knob is exposed to the elements and susceptible to wear and physical breakage. There is a risk that unwanted objects gest entangled in the knob and that dirt enters via the hole in the rifle stock. The knob further reduces the visible appearance of the rifle stock, as well as it may impair the ergonomics of the rifle stock.

SUMMARY OF INVENTION

It is an object of the invention to address at least some of the drawbacks, limitations, problems and issues outlined above. It is also an object to provide an adjusting device for an adjustable rest for a rifle stock which reduces time and cost for manufacturing and retrofitting. A further object is to provide an adjusting device for an adjustable rest for a rifle stock which is less susceptible to breakage and exposure to dirt. Another object is to provide an adjusting device for an adjustable rest for a rifle stock which is more ergonomic and visually attractive. A further object is to provide an adjusting device for an adjustable rest for a rifle stock which is more robust and provides reduced play in a release position and during adjustment. A further object is to provide an adjusting device for an adjustable rest for a rifle stock which is more robust and secure and reduces the risk of unwanted release from the rifle stock during a recoil of a rifle.

According to one embodiment, an adjusting device for an adjustable rest for a rifle stock is provided, comprising: a first portion adapted to be fixedly arranged to the rifle stock, an adjusting portion adapted to be releasably engaged with the first portion and movable between an engaged, locking position and a disengaged, release position upon actuation of the adjusting portion, wherein the adjusting portion is adjustable in relation to the first portion in a release position, and wherein the adjusting portion is locked in relation to the first portion 4 in the locking position, wherein the adjusting portion is adapted to be fixedly arranged to the adjustable rest.

According to one embodiment, an adjusting device for an adjustable rest for a rifle stock is provided, comprising: a first portion adapted to be fixedly arranged to the rifle stock, an adjusting portion adapted to be releasably engaged with the first portion and rotationally movable around a pivot axis in relation to the first portion between an engaged, locking position and a disengaged, release position upon actuation of the adjusting portion, wherein the adjusting portion is adjustable in relation to the first portion in a direction parallel to the pivot axis in a release position, and wherein the adjusting portion is locked in the direction parallel to the pivot axis in relation to the first portion in the locking position, wherein the adjusting portion is adapted to be fixedly arranged to the adjustable rest.

According to one embodiment, a biasing device is adapted to force the adjusting portion towards the locking position.

According to one embodiment, the first portion comprises a first opening a second opening and a third opening, wherein the first opening and second opening comprises respective locking surfaces, wherein the adjusting portion comprises a first locking device comprising a locking surface, wherein the first locking device is adapted to be arranged in the first opening, and further adapted to releasably engage with the locking surface of the first opening, a second locking device 5*b* comprising a locking surface wherein the second locking device is adapted to be arranged in the second opening, and further adapted to releasably engage with the locking surface of the second opening, a pivot shaft adapted to be slidingly and pivotally arranged in the third opening of the first portion, wherein the centre axis of the pivot shaft forms a pivot axis, wherein the adjusting portion is biased in a locking position, wherein the adjusting portion is adapted to rotate around the pivot axis upon actuation of the adjusting portion, whereby the first locking device 5*a* disengages from the locking surface of the first opening and the second locking device disengages from the locking surface of the second opening, whereby the adjusting portion moves towards the release position for enabling adjusting of the adjusting portion in relation to the first portion in a direction parallel to the pivot axis.

According to one embodiment, the first portion comprises a first opening and a second opening, wherein the first opening and second opening comprises respective locking surfaces, wherein the adjusting portion comprises a first locking device comprising a locking surface, wherein the first locking device is adapted to be arranged in the first opening, and further adapted to releasably engage with the locking surface of the first opening, a second locking device comprising a locking surface wherein the second locking device is adapted to be arranged in the second opening, and further adapted to releasably engage with the locking surface of the second opening, wherein the adjusting portion is biased in a locking position, wherein the adjusting portion is adapted to rotate around a pivot axis upon actuation of the adjusting portion, whereby the first locking device disengages from the locking surface of the first opening and the second locking device disengages from the locking surface of the second opening, whereby the adjusting portion moves towards the release position for enabling adjusting of the adjusting portion in relation to the first portion in a direction parallel to the pivot axis.

According to one embodiment, he first portion comprises a first opening and a second opening, wherein the first opening comprises a locking surface, wherein the adjusting portion comprises a first locking device comprising a locking surface, wherein the first locking device is adapted to be arranged in the first opening, and further adapted to releasably engage with the locking surface of the first opening, a second locking device comprising a locking surface wherein the second locking device is adapted to be arranged in the second opening, wherein the centre axis of the second locking device forms a pivot axis wherein the adjusting portion is biased in a locking position by a biasing device, wherein the biasing device comprises a biasing portion and a first spring device, wherein the biasing portion is pivotally arranged on the first portion, wherein the biasing portion comprises a locking surface, wherein the second locking device is further adapted to releasably engage with the locking surface, wherein the adjusting portion is adapted to rotate around the pivot axis upon actuation of the adjusting portion, whereby the first locking device disengages from the locking surface of the first opening and the second locking device disengages from the locking surface of the biasing portion, whereby the adjusting portion moves towards the release position for enabling adjusting of the adjusting portion in relation to the first portion in a direction parallel to the pivot axis.

According to one embodiment, the adjusting portion further comprises a retaining device, wherein the first locking device and second locking device and pivot shaft, is fixedly arranged in the retaining device.

According to one embodiment, the first opening and second opening are shaped to partially encompass the circumference of the first locking device and second locking device at a respective locking portion, wherein the locking portions comprises the locking surfaces of the first portion.

According to one embodiment, the first opening and second opening are shaped to enable the movement of the first locking device and second locking device in a release direction out of and away from the locking portions of the first and second openings, to a release position of the adjusting portion upon rotation of the adjusting portion around the pivot axis.

According to one embodiment, the first locking device and second locking device are elongatedly shaped to extend in a main extension direction, wherein the main direction is parallel to the pivot axis when the first and second locking devices and pivot shaft are arranged in the respective first opening, second opening and third opening.

According to one embodiment, the locking surfaces comprises locking teeth or grooves.

According to one embodiment, the locking teeth or grooves of the locking devices and the first and second openings are shaped as alternately increased and reduced radii portions adapted to matingly engage with each other, wherein the height of the radii portions in the main extension direction of the locking devices and holes parallel to the pivot axis, defines the adjusting steps of the adjusting device.

According to one embodiment, the radii of the locking teeth or grooves of the locking devices and/or the openings are shaped such that the adjusting portion requires a rotation of 1-10°, more preferably, 1-5°, most preferably 2.5° around the pivot point 5*c*', to move from a locking position to a release position.

According to one embodiment, the openings are through-holes.

According to one embodiment, the adjusting portion is biased towards a locking position by a biasing device, comprising at least a first spring device arranged to press the first locking device and second locking device towards the locking surface of the first and second opening respectively.

According to one embodiment, the first and second locking devices and pivot shaft are cylinder shaped.

According to one embodiment, a locking pin is arranged on the pivot shaft to protrude in a perpendicular direction in relation to the pivot axis to prevent removal of the adjusting portion from the first portion.

According to one embodiment, the retaining device is adapted to be fixedly arranged to the adjustable rest.

According to one embodiment, the adjusting portion is biased towards a locking position by at least a second spring device arranged to press the first locking device and second locking device towards the locking surface of the first and second opening respectively.

According to one embodiment, the first opening and second opening of the first portion are shaped to retain the spring devices and to pre bend the spring devices so that they press the first locking device and second locking device towards the locking surface of the first and second opening respectively.

According to one embodiment, a rifle stock is provided comprising an adjusting device according to any of the embodiments described above, e.g. in [0005]-[0022], wherein the first portion is fixedly arranged in the rifle stock and the adjusting portion is fixedly arranged in an adjustable cheek rest.

According to one embodiment, a rifle stock is provided comprising an adjusting device according to any of the embodiments described above, e.g. in [0005]-[0022], wherein the first portion is fixed in the rifle stock and the adjusting portion is fixedly arranged in an adjustable shoulder rest.

According to one embodiment, a rest for a rifle stock is provided, comprising an adjusting device according to any of the embodiments described above, e.g. in [0005]-[0022].

According to one embodiment, a rifle is provided, comprising a rifle stock as described above, e.g. in [0023]-[0024].

Further possible features and benefits of this solution will become apparent from the detailed description below.

BRIEF DESCRIPTION OF DRAWINGS

The invention is now described, by way of example, with reference to the accompanying drawings, in which.

DESCRIPTION OF EMBODIMENTS

Figure 1:
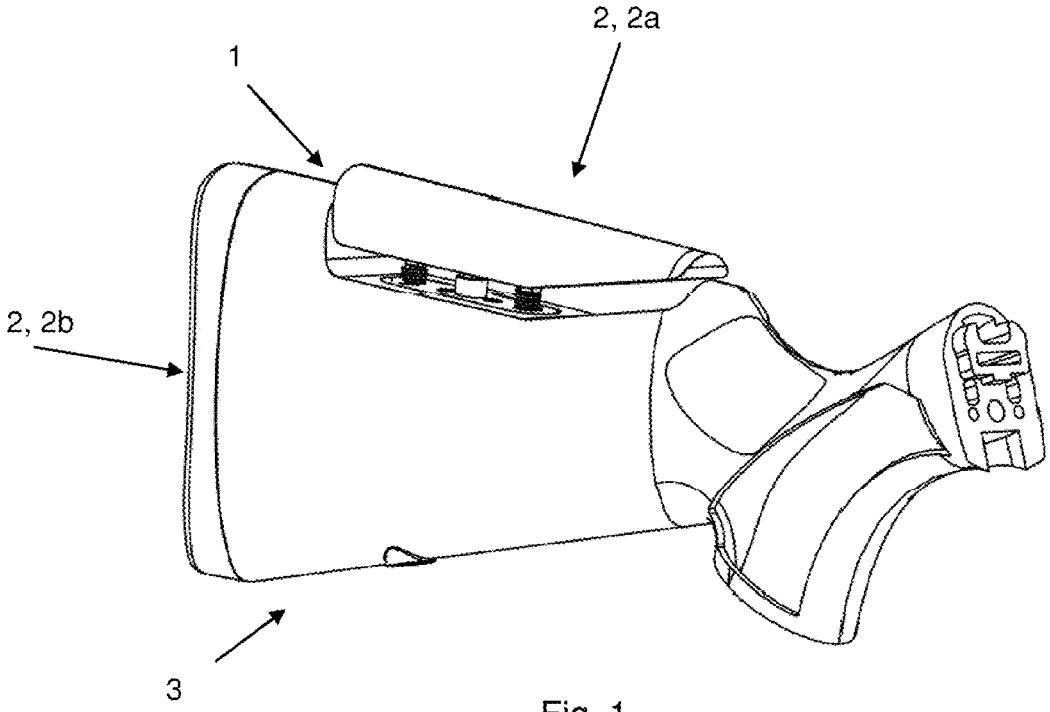
FIG. 1 shows a perspective view of a rifle stock comprising an adjusting device according to one embodiment of the invention.

In the following, a detailed description of the invention will be given. In the drawing figures, like reference numerals designate identical or corresponding elements throughout the several figures. It will be appreciated that these figures are for illustration only and are not in any way restricting the scope of the invention.

FIG. 1 illustrates a perspective view of a rifle stock 3 comprising an adjusting device 1 for an adjustable rest 2, 2*a*, 2*b*. According to one embodiment, as seen in FIG. 1 the adjusting device 1 is used for adjusting an adjustable cheek rest 2*a* also known as comb rest. The adjusting of the cheek rest 2*a* is suitable in order to arrange the cheek and thus head and eyes in a desired relation to a telescopic sight arranged on a rifle. According to one embodiment, the adjusting device 1 is used for adjusting an adjustable shoulder rest 2*b* which can be seen in FIG. 8*b*.

Figure 2:
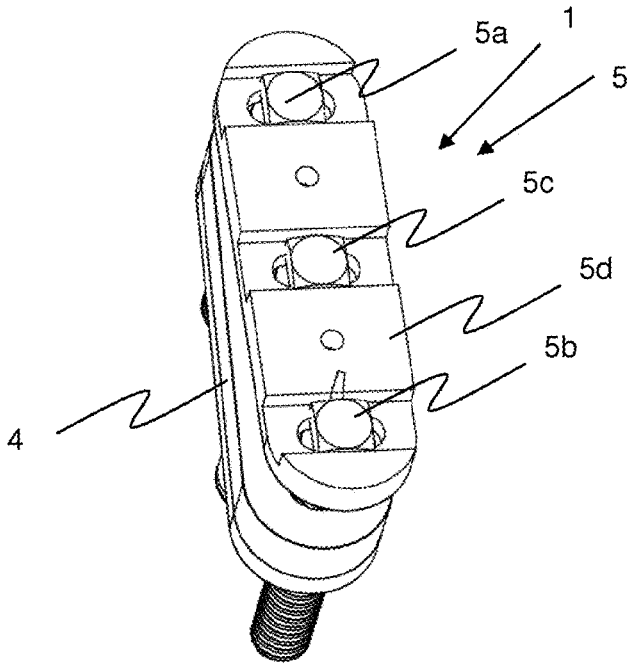
FIG. 2 is a perspective view of an adjusting device according FIG. 1.

FIG. 2 is a perspective view of an adjusting device 1 according to one embodiment of the invention. The adjusting portion 5 is shown comprising a first locking device 5*a*, a second locking device 5*b* and a pivot shaft 5*c* fixedly arranged in the retaining device 5*d* forming part of the adjusting portion 5. According to one embodiment, the retaining device 5*d* is adapted to be fixedly arranged to the adjustable rest 2, 2*a*, 2*b*. A first portion 4 adapted to be fixedly arranged in the rifle stock 3 is shown. The adjusting portion 5 is adapted to be releasably engaged with the first portion 4.

Figure 3A:
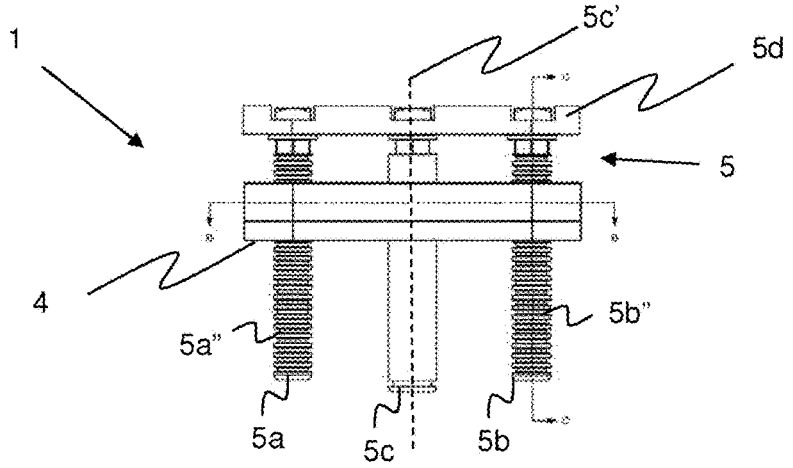
FIG. 3*a* is a side view of an adjusting device as seen in FIG. 2 in a locking position.

FIG. 3*a* is a side view of an adjusting device 1 for an adjustable rest 2, 2*a*, 2*b* for a rifle stock 3 as seen in FIG. 2, in a locking position. The adjusting device comprises a first portion 4 adapted to be fixedly arranged to the rifle stock 3, an adjusting portion 5 adapted to be releasably engaged with the first portion 4 and movable between an engaged, locking position and a disengaged, release position upon actuation of the adjusting portion 5, wherein the adjusting portion 5 is adjustable in relation to the first portion 4 in a release position, and wherein the adjusting portion is locked in relation to the first portion 4 in the locking position. According to one embodiment, the adjusting portion 5 is adjustably locked in relation to the first portion 4 in the locking position. According to one embodiment, the adjusting portion 5 is locked or adjustably locked in relation to the first portion 4 in a direction essentially perpendicular to the moving direction of the adjusting portion 5 between a release and locking position. According to one embodiment, the adjusting portion 5 is rotationally movable between an engaged, locking position and a disengaged, release position upon actuation of the actuation of the adjusting portion 5, wherein the adjusting direction is essentially parallel to the pivot axis defined by the rotation. The adjusting portion 5 is further adapted to be fixedly arranged to the adjustable rest 2, 2*a*, 3*b*. Thus, the actuatable adjusting portion 5 is arranged on the actual rest 2, 2*a*, 3*b* and adapted to move together with the rest 2, 2*a*, 2*b* during adjusting of the adjustable rest 2, 2*a*, 2*b*.

Figure 3B:
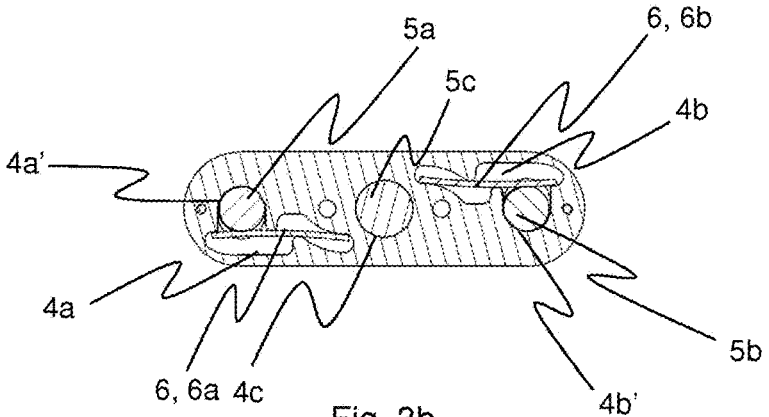
FIG. 3*b* is a cross-section view of an adjusting device as seen in FIG. 3*a* along line B-B.
Figure 3C:
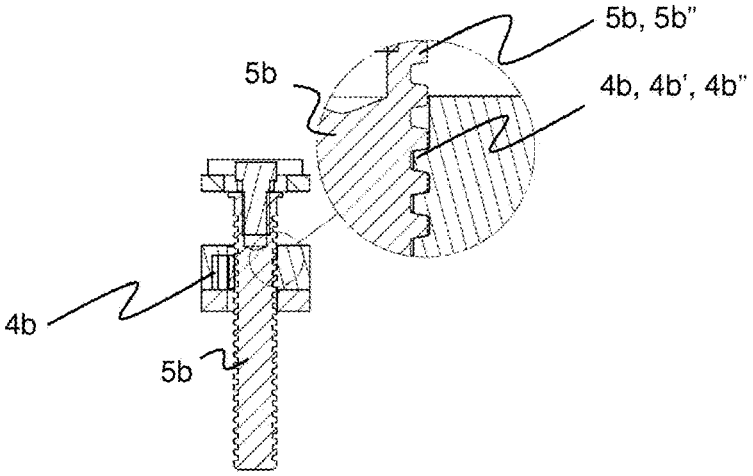
FIG. 3*c* is a cross-section view of an adjusting device as seen in FIG. 3*a* along line C-C.

As can be further seen in FIG. 3*b*, showing a cross-section view of an adjusting device as seen in FIG. 3*a* along line B-B, according to one embodiment, the first portion 4 comprises a first opening 4*a* a second opening 4*b* and a third opening 4*c*, wherein the first opening 4*a* and second opening 4*b* comprises respective locking surfaces 4*a*", 4*b*", further seen in FIG. 3*c*. According to one embodiment, the openings 4*a*, 4*b*, 4*c* are through-holes. According to one embodiment, the first portion 4 is fixedly arranged with the second opening 4*b* arranged closest to the gun barrel opening when used for an adjustable cheek rest 2*a*.

The adjusting portion 5 comprises a first locking device 5*a* comprising a locking surface 5*a*", wherein the first locking device 5*a* is adapted to be arranged in the first opening 4*a*, and further adapted to releasably engage with the locking surface 4*a*" of the first opening 4*a*. The adjusting portion 5 further comprises a second locking device 5*b* comprising a locking surface 5*b*" wherein the second locking device 5*b* is adapted to be arranged in the second opening 4*b*, and further adapted to releasably engage with the locking surface 4*b*" of the second opening 4*b*. Further, the adjusting portion 5 comprises a pivot shaft 5*c* adapted to be slidingly and pivotally arranged in the third opening 4*c* of the first portion 4, wherein the centre axis of the pivot shaft 5*c* forms a pivot axis 5*c*'. The adjusting portion 5 is thus adapted to pivot around the pivot axis 5*c*'. According to one embodiment, the adjusting portion 5 is thus adapted to pivot around the pivot axis 5*c*' in relation to the first portion 4. According to one embodiment, the adjusting portion 5 is biased in a locking position, i.e. the locking position shown in FIG. 3*a*, 3*b*, 3*c*. According to one embodiment, being biased in a locking position is similar to being biased e.g. into, to or towards a locking position. Such biasing action may be generated by a biasing device 6. According to one embodiment, the adjusting device 1 comprises the biasing device 6. According to one embodiment, the biasing device comprises at least a first spring device 6*a*, 6*b* arranged to press the first locking device 5*a* and second locking device 5*b* towards the locking surface 4*a*", 4*b*" of the first and second opening 4*a*, 4*b* respectively. According to one embodiment, the adjusting portion 5 is biased towards a locking position by at least a second spring device 6*b* arranged to press the first locking device 5*a* and second locking device 5*b* towards the locking surface 4*a*", 4*b*" of the first and second opening 4*a*, 4*b* respectively. According to one embodiment, the first opening 4*a* and second opening 4*b* of the first portion 4 are shaped to retain the spring devices 6*a*, 6*b* and to pre bend the spring devices 6*a*, 6*b* so that they press the first locking device 5*a* and second locking device 5*b* towards the locking surface 4*a*", 4*b*" of the first and second opening 4*a*, 4*b* respectively. According to one embodiment, the spring devices 6*a*, 6*b* are leaf springs or plate springs.

According to one embodiment, the first opening 4*a* and second opening 4*b* are shaped to partially encompass the circumference of the first locking device 5*a* and second locking device 5*b* at a respective locking portion 4*a*', 4*b*', wherein the locking portions 4*a*', 4*b*' comprises the locking surfaces 4*a*", 4*b*" of the first portion 4.

FIG. 3*c* is a cross-section view of an adjusting device as seen in FIG. 3*a* along line C-C. FIG. 3*c* further discloses an enlarged view of the locking surface 5*b*" of the locking device 5 and locking surface 4*b*" of the second opening 4*b* in an engaged, locking position, wherein the adjusting portion 5 is locked in relation to the first portion 4 in a direction parallel to the pivot axis 5*c*'. A corresponding structure is provided for the opposite side of the adjusting device 1, i.e. wherein the first locking device 5*a* comprises a locking surface 5*a*" and a locking surface 4*a*" of the second opening 4*b*.

Figure 4A:
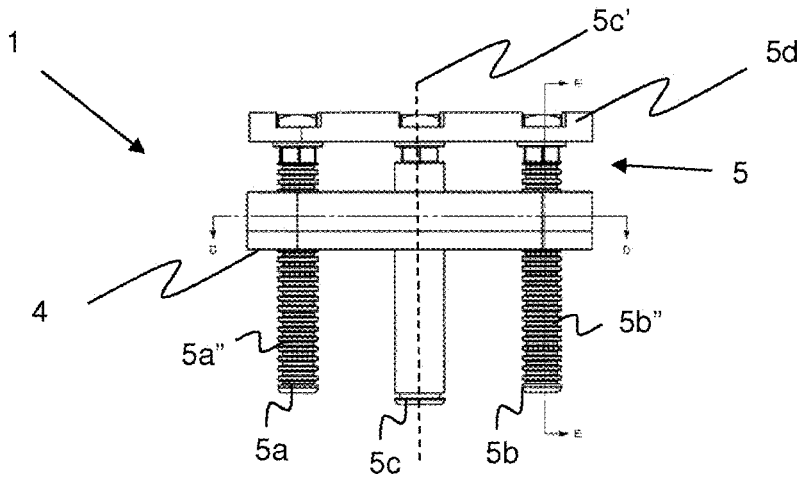
FIG. 4*a* is a side view of an adjusting device as seen in FIG. 2 in a release position.

FIG. 4*a* is a side view of an adjusting device as seen in FIG. 2 in a release position, i.e. wherein the adjusting portion 5 is adjustable in relation to the first portion 4 in a direction parallel to the pivot axis 5*c*'. According to one embodiment, the first opening 4*a* and second opening 4*b* are shaped to enable the movement of the first locking device 5*a* and second locking device 5*b* in a release direction out of and away from the locking portions 4*a*', 4*b*' of the first and second openings 4*a*, 4*b*, to a release position of the adjusting portion 5 upon rotation of the adjusting portion 5 around the pivot axis 5*c*'.

According to one embodiment, the adjusting portion 5 is adapted to rotate around the pivot axis 5*c*' upon actuation of the adjusting portion 5, whereby the first locking device 5*a* disengages from the locking surface 4*a*" of the first opening 4*a* and the second locking device 5*b* disengages from the locking surface 4*b*" of the second opening 4*b*, whereby the adjusting portion 5 moves towards the release position for enabling adjusting of the adjusting portion 5 in relation to the first portion 4 in a direction parallel to the pivot axis 5*c*'.

Thus, according to one embodiment, the shape of the first and second opening 4*a*, 4*b* enabling such of the locking devices 5*a*, 5*b* is such that the encompassing portion 4*a*', 4*b*' is only partially encompassing the locking devices 5*a*, 5*b*, i.e. partially the openings 4*a*, 4*b* are not encompassing the locking devices 5*a*, 5*b* but opens up and enlarges so that the locking devices 5*a*, 5*b* faces a free space within the respective openings 4*a*, 4*b*. The enlarged allowance portions of the openings 4*a*, 4*b* are sufficiently large and extends sufficiently in a direction parallel to the movement direction of the locking devices 5*a*, 5*b* during a release movement/actuation of the adjusting device 5, to enable the movement of the first locking device 5*a* and second locking device 5*b* in a release direction out of and away from the locking portions 4*a*', 4*b*' of the first and second openings 4*a*, 4*b*, to a release position of the adjusting portion 5 upon rotation of the adjusting portion 5 around the pivot axis 5*c*'. According to one embodiment, such allowance is at least corresponding to the depth of locking teeth which may form the locking surface 4*a*", 4*b*", 5*a*", 5*b*".

According to one embodiment, the first locking device 5*a* and second locking device 5*b* are elongatedly shaped to extend in a main extension direction, wherein the main direction is parallel to the pivot axis 5*c*' when the first and second locking devices 5*a*, 5*b* and pivot shaft 5*c* are arranged in the respective first opening 4*a*, second opening 4*b* and third opening 4*c*.

According to one embodiment, the first and second locking devices 5*a*, 5*b* and pivot shaft 5*c* are cylinder shaped.

Figure 4B:
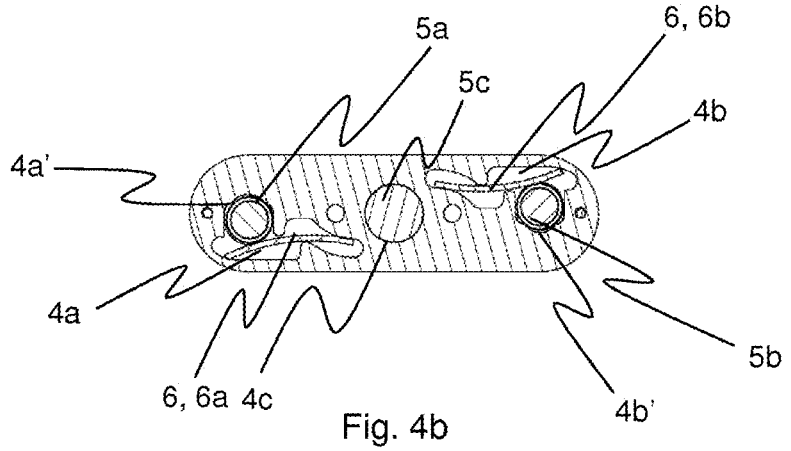
FIG. 4*b* is a cross-section view of an adjusting device as seen in FIG. 4*a* along line D-D.

FIG. 4*b* is a cross-section view of an adjusting device as seen in FIG. 4*a* along line D-D. FIG. 4*b* thus shows the release position of the adjusting portion 5, wherein the adjusting portion 5 has moved against the biasing action of the biasing devices 6*a*, 6*b*, out of and away from the locking portions 4*a*', 4*b*' of the first and second openings 4*a*, 4*b*, to a release position of the adjusting portion 5 upon rotation of the adjusting portion 5 around the pivot axis 5*c*'.

Figure 4C:
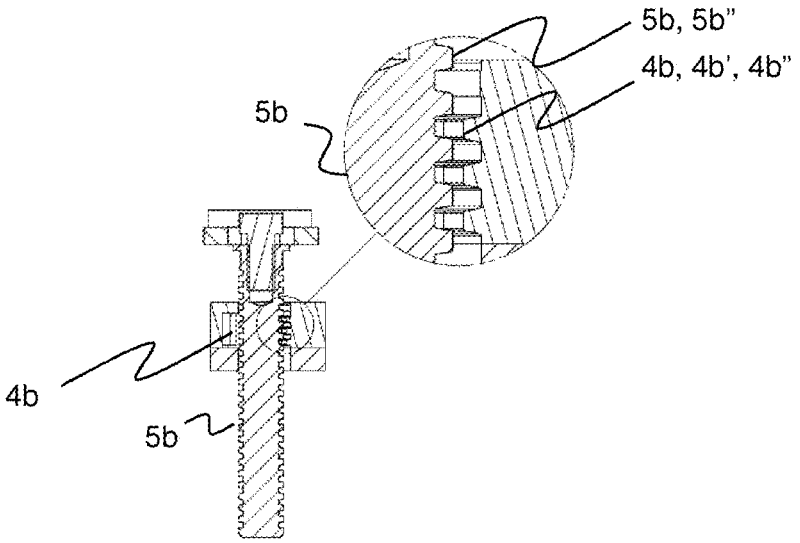
FIG. 4*c* is a cross-section view of an adjusting device as seen in FIG. 4*a* along line E-E.

FIG. 4*c* is a cross-section view of an adjusting device 1 as seen in FIG. 4*a* along line E-E. FIG. 4*c* further discloses an enlarged view of the locking surface 5*b*" of the locking device 5 and locking surface 4*b*" of the second opening 4*b* in an disengaged, release position, wherein the adjusting portion is adjustable in relation to the first portion 4 in relation to the first portion 4 in a direction parallel to the pivot axis 5*c*'.

According to FIG. 4*a*-4*c*, the actuation direction, i.e. the rotation movement, is anti-clockwise. However, by turning the first portion 4 comprising through-holes 4*a*, 4*b*, 4*c*, at 180°, wherein the other side of the first portion is revealed, i.e. flipping the first portion 4 around, an opposite actuation direction is required/achieved. In this case, a clock-wise actuation direction is established. This is an advantage since it enables the freedom of choice when mounting the adjusting device 1 based on if a right handed shooter or left handed shooter is using the adjusting device 1. Generally, irrespective of shooter type, the most weight is placed on the fore most portion of the adjusting device 1, i.e. closes to the gun barrel opening when mounted. To avoid unintended actuation, and subsequent release, of the adjusting device 1 during aiming and shooting for a right handed shooter, the adjusting device 1 is preferably mounted with the second opening 4*b* and second locking device 5*b* in a foremost position. Conversely, for a left hand shooter, the first portion 4 is flipped and again mounted with the second opening 4*b* and second locking device 5*b* in a foremost position to avoid unintentional actuation, and subsequent release, of the adjusting device 1 during aiming and shooting.

Thus, when the shooter takes aim, higher load from the side in form of shooters face and cheekbone is put on the adjustable cheek rest 2*a* in front of the pivot shaft 5*c*, this results in that it automatically locks the locking devices 5*a* 5*b* with a higher force into the first and second openings 4*a*, 4*b* and therefore secures the height of the adjustable cheek rest 2*a* while firing the weapon.

FIG. 4*c*, as well as FIG. 3*c* discloses an embodiment wherein the locking surfaces 4*a*", 4*b*", 5*a*", 5*b*", comprises locking teeth or grooves. According to one embodiment, the locking teeth or grooves of the locking devices 5*a*, 5*b* and the first and second openings 4*a*, 4*b* are shaped as alternately increased and reduced radii portions adapted to matingly engage with each other, wherein the height of the radii portions in the main extension direction of the locking devices 5*a*, 5*b* and holes 4*a*, 4*b*, parallel to the pivot axis 5*c*', defines the adjusting steps of the adjusting device 1. According to one embodiment, the relevant radii are defined in a direction perpendicular to the main extension direction/extension direction of the pivot axis 5*c*'. As described above, the adjusting steps of the adjusting device are thus in a direction parallel to the pivot axis 5*c*'. According to one embodiment, the adjusting steps are in the range of 1-5 mm, more preferably 2-3 mm, most preferably 2 mm.

According to one embodiment, the radii of the locking teeth or grooves of the locking devices 5*a*, 5*b* and/or the openings 4*a*, 4*b* are shaped such that the adjusting portion 5 requires a rotation of 1-10°, more preferably, 1-5°, most preferably 2.5° around the pivot point 5*c*', to move from a locking position to a release position.

Figure 5A:
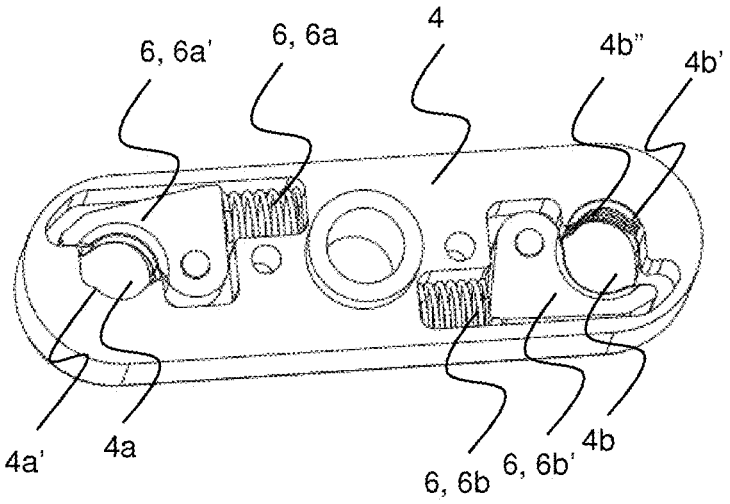
FIG. 5*a* is a perspective view of a first portion of an adjusting device of one embodiment of the invention.
Figure 5B:
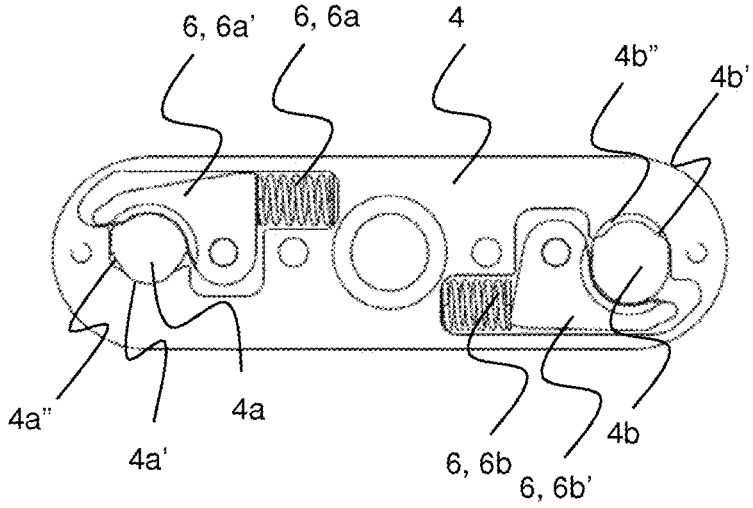
FIG. 5*b* is a side view of the first portion according to FIG. 5*a*.

FIG. 5*a* is a perspective view of a first portion 4 of an adjusting device 1 according to one embodiment of the invention. According to this embodiment, the biasing devices comprises a first spring device 6*a* and a second spring device 6*b*. According to one embodiment, the spring devices 6*a*, 6*b* are coil springs. According to one embodiment, the spring devices 6*a*, 6*b* are arranged in the respective openings 4*a*, 4*b* in an area adapted to fit the spring devices 6*a*, 6*b* such that a movement of the spring devices 6*a*, 6*b* perpendicular to the extension/compression direction of the spring devices 6*a*, 6*b* are limited. A respective biasing portion 6*a*' and 6*b*' are pivotally arranged on the first portion 4 and adapted to act against the movement of the locking devices 5*a*, 5*b* in a release direction out of and away from the locking portions 4*a*', 4*b*' of the first and second openings 4*a*, 4*b*. According to one embodiment, the inner surfaces of the biasing portions 6*a*', 6*b*', i.e. facing the first and second locking devices 5*a*, 5*b* respectively, are adapted for allowing the locking devices 5*a*, 5*b* to slide against said inner surfaces. According to one embodiment, the inner surfaces are essentially flat. FIG. 5*b* is a side view of the first portion 4 according to FIG. 5*a*. Notably, as shown in FIG. 5*a*, 5*b*, the first portion 4 is mirrored in relation to the first portions described in FIG. 3*a*-3*c*, 4*a*-4*c*, i.e. it has been turned over/flipped as described above.

Figure 6A:
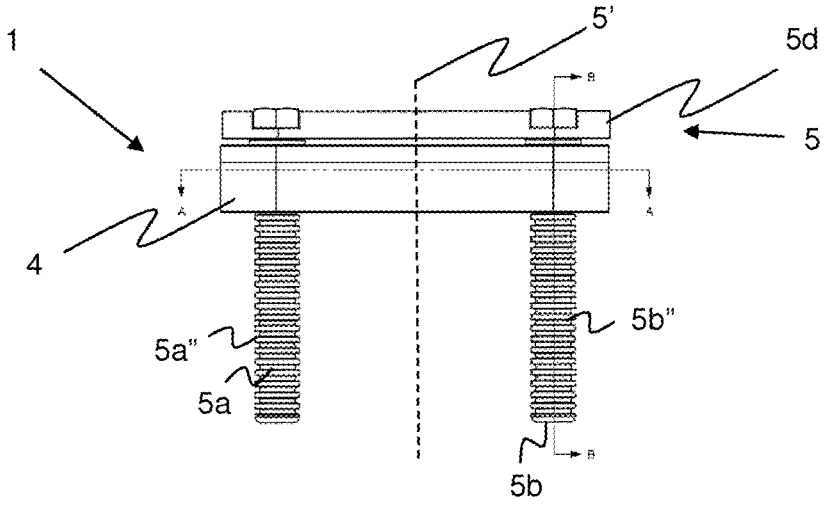
FIG. 6*a* is a side view of an adjusting device 1 according to one embodiment of the invention.

FIG. 6*a* is a side view of an adjusting device 1 according to one embodiment, in a locking position, i.e. wherein the adjusting portion 5 is not adjustable in relation to the first portion 4 in a direction parallel to the pivot axis 5', i.e. locked in relation to the first portion 4 in a direction parallel to the pivot axis 5', wherein the pivot axis 5' is essentially at a center point between the axis of the first locking device 5*a* and second locking device 5*b*. According to one embodiment, as shown in FIG. 6*a*-6*d*, no specific pivot shaft 5*c* is used, but rotation is still generated by the actuation of the adjusting portion 5 around said thereby defined pivot axis 5'. According to this embodiment, the first portion comprises a first opening 4*a* and a second opening 4*b*, wherein the first opening 4*a* and second opening 4*b* comprises respective locking surfaces 4*a*", 4*b*", wherein the adjusting portion 5 comprises a first locking device 5*a* comprising a locking surface 5*a*", wherein the first locking device 5*a* is adapted to be arranged in the first opening 4*a*, and further adapted to releasably engage with the locking surface 4*a*" of the first opening 4*a*, a second locking device 5*b* comprising a locking surface 5*b*" wherein the second locking device (5*b*) is adapted to be arranged in the second opening 4*b*, and further adapted to releasably engage with the locking surface 4*b*" of the second opening 4*b*, wherein the adjusting portion 5 is biased in a locking position. According to one embodiment, a corresponding biasing device 6 as described under FIGS. 5*a*-5*b* is used herein as well. According to one embodiment, the adjusting portion 5 is adapted to rotate around the pivot axis 5' upon actuation of the adjusting portion 5, whereby the first locking device 5*a* disengages from the locking surface 4*a*" of the first opening 4*a* and the second locking device 5*b* disengages from the locking surface 4*b*" of the second opening 4*b*, whereby the adjusting portion 5 moves towards the release position for enabling adjusting of the adjusting portion 5 in relation to the first portion 4 in a direction parallel to the pivot axis 5'.

Figure 6B:
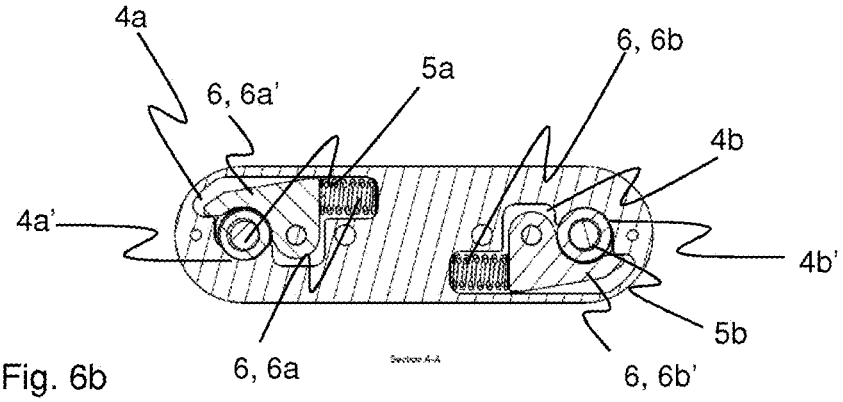
FIG. 6*b* is a cross-section view of an adjusting device 1 as seen in FIG. 6*a* along line A-A in a locking position.

FIG. 6*b* is a cross-section view of an adjusting device 1 as seen in FIG. 6*a* along line A-A. FIG. 6*b* thus shows the locking position of the adjusting portion 5 in a similar way as shown under FIG. 5*a*-5*b* and described in connection to these FIGS. 5*a*-5*b*.

Figure 6C:
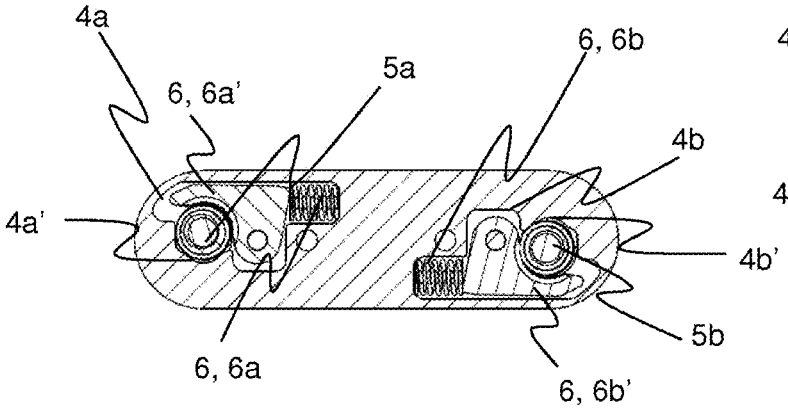
FIG. 6*c* is a cross-section view of an adjusting device 1 as seen in FIG. 6*a* along line A-A in a release position.

FIG. 6*c* is a cross-section view of an adjusting device 1 as seen in FIG. 6*a* along line A-A, in a release position, i.e. wherein the adjusting portion 5 is adjustable in relation to the first portion 4 in a direction parallel to the pivot axis 5'.

Figure 6D:
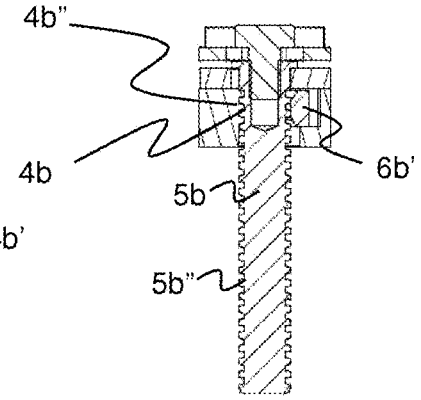
FIG. 6*d* is a cross-section view of an adjusting device as seen in FIG. 6*a* along line B-B.

FIG. 6*d* is a cross-section view of an adjusting device as seen in FIG. 6*a* along line B-B. A corresponding structure is provided for the opposite side of the adjusting device 1, i.e. comprising the first locking device 5*a*, the first opening 4*a* and biasing portion 6*a*'.

Figure 7A:
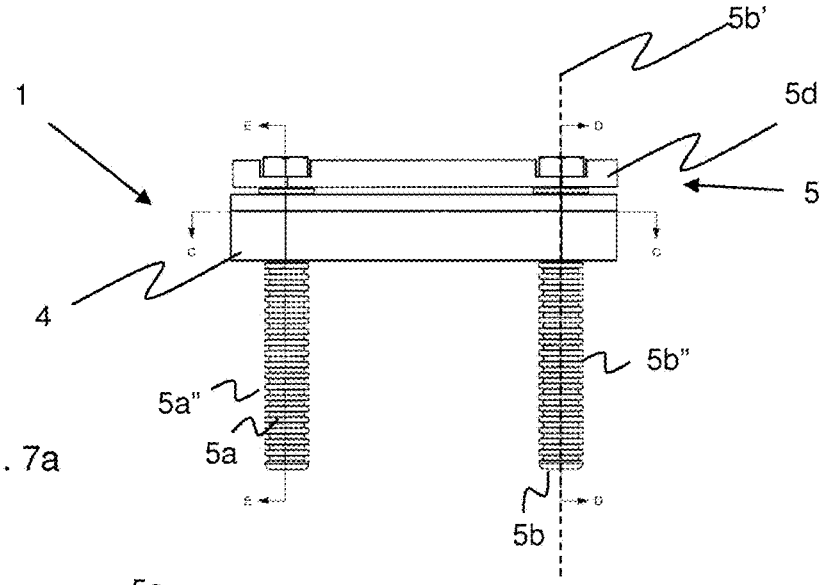
FIG. 7*a* is a side view of an adjusting device 1 according to one embodiment of the invention.

FIG. 7*a* is a side view of an adjusting device 1 according to one embodiment, in a release position, i.e. wherein the adjusting portion 5 is adjustable in relation to the first portion 4 in a direction parallel to the pivot axis 5*b*'. According to one embodiment, shown in FIG. 7*a*-7*c*, the first portion comprises a first opening 4*a* and a second opening 4*b*, wherein the first opening 4*a* comprises a locking surface 4*a*". The adjusting portion 5 comprises a first locking device 5*a* comprising a locking surface 5*a*", wherein the first locking device 5*a* is adapted to be arranged in the first opening 4*a*, and further adapted to releasably engage with the locking surface 4*a*" of the first opening 4*a*. The adjusting portion further comprises a second locking device 5*b* comprising a locking surface 5*b*" wherein the second locking device 5*b* is adapted to be arranged in the second opening 4*b*, wherein the centre axis of the second locking device 5*b* forms a pivot axis 5*b*'.

Figure 7B:
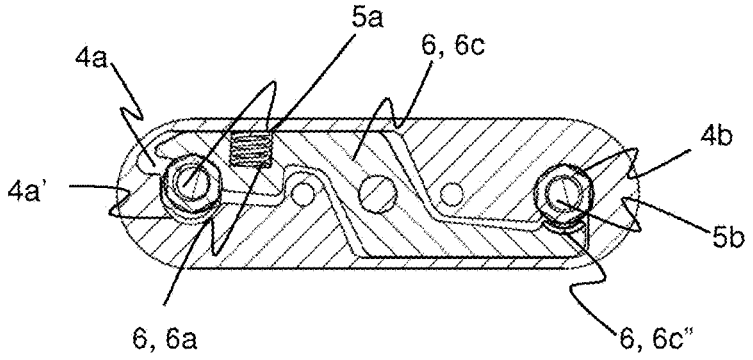
FIG. 7*b* is a cross-section view of an adjusting device 1 as seen in FIG. 7*a* along line C-C.

FIG. 7*b* is a cross-section view of an adjusting device 1 as seen in FIG. 7*a* along line C-C, wherein the adjusting device 1 is in a release position.

Further, as can be seen in FIG. 7*b*, the adjusting portion 5 is biased in a locking position by a biasing device 6, wherein the biasing device 6 comprises a biasing portion 6*c* and a first spring device 6*a*, wherein the biasing portion 6*c* is pivotally arranged on the first portion 4, wherein the biasing portion 6*c* comprises a locking surface 6*c*", wherein the second locking device 5*b* is further adapted to releasably engage with the locking surface 6*c*". The adjusting portion 5 is adapted to rotate around the pivot axis 5*b*' upon actuation of the adjusting portion 5, whereby the first locking device 5*a* disengages from the locking surface 4*a*" of the first opening 4*a* and the second locking device 5*b* disengages from the locking surface 6*c*'" of the biasing portion 6*c*, whereby the adjusting portion 5 moves towards the release position for enabling adjusting of the adjusting portion 5 in relation to the first portion 4 in a direction parallel to the pivot axis 5*b*'.

According to one embodiment, the locking surface 6*c*" comprises locking teeth or grooves for matingly engaging with the locking surface 5*b*" of the second locking device 5*b* comprising corresponding locking teeth or grooves.

According to one embodiment the inner surface of the second opening 4*b* is adapted for allowing the locking device 5*b* to slide against it. According to one embodiment, the inner surface of the second opening 4*b* is essentially flat.

According to one embodiment, the first opening 4*a* and the second opening 4*b* are part of the same opening. According to one embodiment, the first opening 4*a* and second opening 4*b* are the same opening.

Figure 7C:
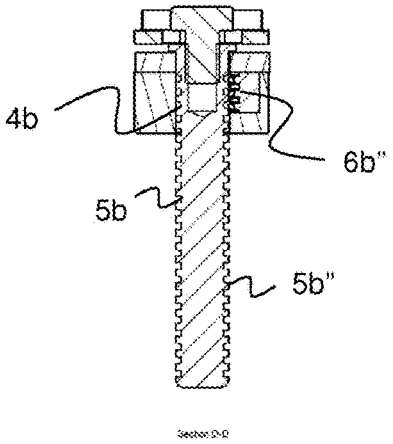
FIG. 7*c* is a cross-section view of an adjusting device as seen in FIG. 7*a* along line D-D.

FIG. 7*c* is a cross-section view of an adjusting device 1 as seen in FIG. 7*a* along line D-D.

Figure 7D:
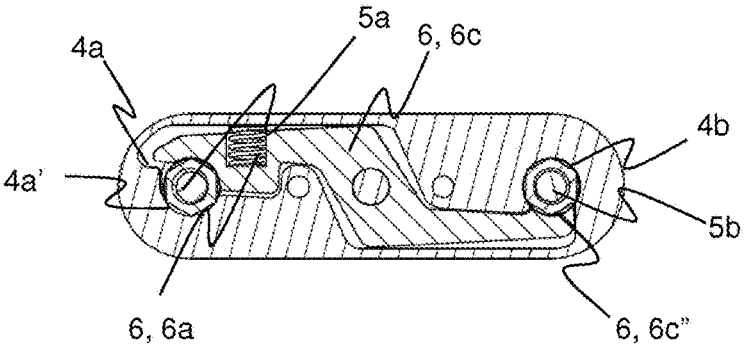
FIG. 7*d* is a cross-section view of an adjusting device 1 as seen in FIG. 7*a* along line C-C, wherein the adjusting device 1 is in a locking position.

FIG. 7*d* is a cross-section view of an adjusting device 1 as seen in FIG. 7*a* along line C-C, wherein the adjusting device 1 is in a locking position.

Figure 7E:
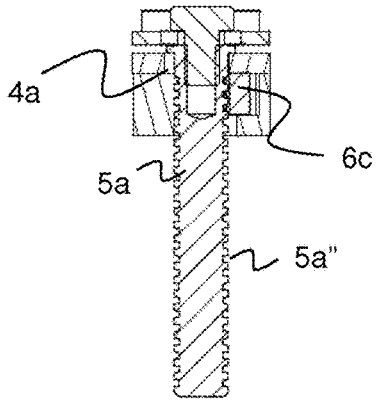
FIG. 7*e* is a cross-section view of an adjusting device 1 as seen in FIG. 7*a* along line E-E.

FIG. 7*e* is a cross-section view of an adjusting device 1 as seen in FIG. 7*a* along line E-E.

According to one embodiment, shown in e.g. FIG. 1-7*e* above, an adjusting device 1 for an adjustable rest 2, 2*a*, 2*b* for a rifle stock 3, is provided comprising: a first portion 4 adapted to be fixedly arranged to the rifle stock 3, an adjusting portion (5) adapted to be releasably engaged with the first portion 4 and rotationally movable around a pivot axis 5*b*',5*c*', 5' in relation to the first portion 4 between an engaged, locking position and a disengaged, release position upon actuation of the adjusting portion 5, wherein the adjusting portion 5 is adjustable in relation to the first portion 4 in a direction parallel to the pivot axis 5*b*', 5*c*', 5' in a release position, and wherein the adjusting portion is locked in the direction parallel to the pivot axis 5*b*', 5*c*', 5' in relation to the first portion 4 in the locking position. According to one embodiment, a biasing device 6 is adapted to force or bias the adjusting portion 5 towards the locking position, i.e. the adjusting portion 5 is biased in, into, to or towards a locking position by a biasing device 6 as described herein. According to one embodiment, the biasing device 6 may comprise at least one of all the various described embodiments of the biasing device 6 described herein. According to one embodiment, the adjusting portion 5 is adapted to be fixedly arranged to the adjustable rest 2, 2*a*, 2*b*. According to one embodiment, as is realized by a skilled person a parallel direction to the pivot axis 5*b*', 5*c*', 5' comprises all directions that is an essentially parallel direction to the pivot axis 5*b*', 5*c*', 5'.

According to one embodiment, the first portion 4 comprises a first opening 4*a* and a second opening 4*b*, wherein at least the first opening 4*a* comprises a locking surface 4*a*", wherein the adjusting portion 5 comprises a locking surface 5*a*", wherein the first locking device 5*a* is adapted to be arranged in the first opening 4*a*, and further adapted to releasably engage with the locking surface 4*a*" of the first opening 4, a second locking device 5*b* comprising a locking surface 5*b*", wherein the second locking device 5*b* is adapted to be arranged in the second opening 4*b*. According to one embodiment, the second opening 4*b* comprises locking surface 4*b*", i.e. the first opening 4*a* and second opening 4*b* comprises respective locking surfaces 4*a*", 4*b*", wherein the second locking device 5*b* is adapted to releasably engage with the locking surface 4*b*" of the second opening 4*b*, a pivot shaft 5*c* adapted to be slidingly and pivotally arranged in the third opening 4*c* of the first portion 4, wherein the centre axis of the pivot shaft 5*c* forms a pivot axis 5*c*', wherein the adjusting portion 5 is biased in a locking position, wherein the adjusting portion 5 is adapted to rotate around the pivot axis 5*c*' upon actuation of the adjusting portion 5, whereby the first locking device 5*a* disengages from the locking surface 4*a*" of the first opening 4*a* and the second locking device 5*b* disengages from the locking surface 4*b*" of the second opening 4*b*, whereby the adjusting portion 5 moves towards the release position for enabling adjusting of the adjusting portion 5 in relation to the first portion 4 in a direction parallel to the pivot axis 5*c*'.

According to one embodiment, the first opening 4*a* and second opening 4*b* comprises respective locking surfaces 4*a*", 4*b*", wherein the adjusting portion 5 comprises a first locking device 5*a* comprising a locking surface 5*a*", wherein the first locking device 5*a* is adapted to be arranged in the first opening 4*a*, and further adapted to releasably engage with the locking surface 4*a*" of the first opening 4*a*, a second locking device 5*b* comprising a locking surface 5*b*" wherein the second locking device 5*b* is adapted to be arranged in the second opening 4*b*, and further adapted to releasably engage with the locking surface 4*b*" of the second opening 4*b*, wherein the adjusting portion 5 is biased in a locking position, wherein the adjusting portion 5 is adapted to rotate around a pivot axis 5' upon actuation of the adjusting portion 5, whereby the first locking device 5*a* disengages from the locking surface 4*a*" of the first opening 4*a* and the second locking device 5*b* disengages from the locking surface 4*b*" of the second opening 4*b*, whereby the adjusting portion 5 moves towards the release position for enabling adjusting of the adjusting portion 5 in relation to the first portion 4 in a direction parallel to the pivot axis 5'.

According to one embodiment, the adjusting portion 5 comprises a first locking device 5*a* comprising a locking surface 5*a*", wherein the first locking device 5*a* is adapted to be arranged in the first opening 4*a*, and further adapted to releasably engage with the locking surface 4*a*" of the first opening 4*a*, a second locking device 5*b* comprising a locking surface 5*b*" wherein the second locking device 5*b* is adapted to be arranged in the second opening 4*b*, wherein the centre axis of the second locking device 5*b* forms a pivot axis 5*b*' wherein the adjusting portion 5 is biased in a locking position by a biasing device 6, wherein the biasing device 6 comprises a biasing portion 6*c* and a first spring device 6*a*, wherein the biasing portion 6*c* is pivotally arranged on the first portion 4, wherein the biasing portion 6*c* comprises a locking surface 6*c*", wherein the second locking device 5*b* is further adapted to releasably engage with the locking surface 6*c*", wherein the adjusting portion 5 is adapted to rotate around the pivot axis 5*b*' upon actuation of the adjusting portion 5, whereby the first locking device 5*a* disengages from the locking surface 4*a*" of the first opening 4*a* and the second locking device 5*b* disengages from the locking surface 6*c*" of the biasing portion 6*c*, whereby the adjusting portion 5 moves towards the release position for enabling adjusting of the adjusting portion 5 in relation to the first portion 4 in a direction parallel to the pivot axis 5*b*'.

Figure 8A:
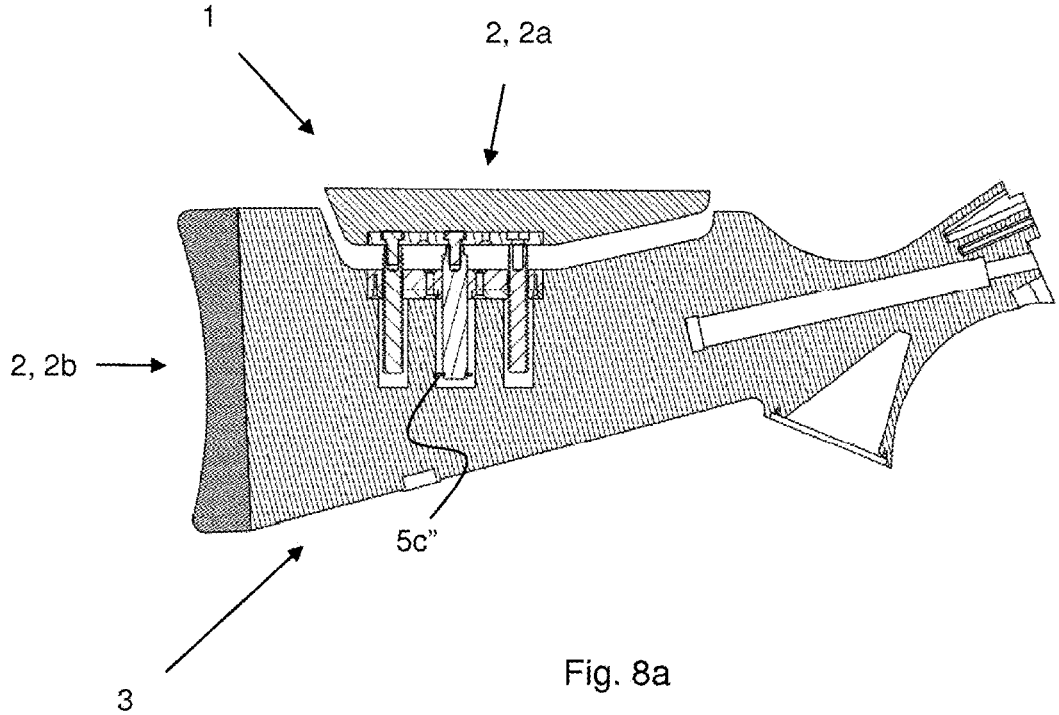
FIG. 8*a* is a cross-section of a rifle stock comprising an adjusting device according to the invention.

FIG. 8*a* is a cross-section of a rifle stock 3 comprising an adjusting device 1 according to one embodiment of the invention. However, any embodiment described herein may correspondingly be comprised in the rifle stock 3. The adjusting device 1 is herein used for an adjustable cheek rest 2*a*. The rifle stock 3 may be prepared by using a separated portion of the rifle stock 3 as an adjustable rest 2*b*. Alternatively, a separate adjustable rest 2*b* may be arranged on an existing rifle stock 3. Further, the rifle stock 3 is prepared by forming or drilling holes for receiving the elongated locking devices 5*a*, 5*b* and pivot shaft 5*c*. The surface of the rifle stock 3 at the prepared holes is made essentially flat to receive the first portion 4 and to allow the first portion to be fixedly arranged to the rifle stock 3. The adjustable rest 2*a* is prepared to receive the adjusting portion 5. According to one embodiment, the adjusting portion 5 is fixedly arranged to the adjustable rest 2*a* directly connecting the locking devices 5*a*, 5*b* and pivot shaft by suitable means. According to one embodiment, the adjusting portion 5 is fixedly arranged to the adjustable rest 2*a* by fixedly arranging the retaining device 5*d* to the adjustable rest 2*a*. Adjusting of the adjustable rest 2*a* is hereby carried out by actuating the adjustable rest 2*a*, and thus the adjusting portion 5, thus carrying out a movement of the first locking device 5*a* and second locking device 5*b* in a release direction out of and away from the locking portions 4*a*', 4*b*' of the first and second openings 4*a*, 4*b*, to a release position of the adjusting portion 5 upon rotation of the adjusting portion 5 around the pivot axis 5*c*' and moving the adjustable rest 2*a* and thus adjusting portion 5 in a direction along the pivot axis 5*c*' either away from the rifle stock 3 or towards the rifle stock 3. Thereafter, releasing the adjustable rest 2*a* and adjusting portion 5 at a selected position/height, whereby the biasing action of the biasing device forces the adjustable rest 2*a* and adjusting portion 5 to rotate around the pivot axis 5*c*' towards and to a locking position, wherein the locking surfaces 5*a*", 5*b*" of the locking devices 5*a*, 5*b* again matingly engages with the locking surfaces 4*a*", 4*b*" of the openings 4*a*, 4*b*, wherein the adjustable rest 2*a* and adjusting portion 5 is locked in relation to the first portion 4 in a direction parallel to the pivot axis 5*c*'.

According to one embodiment, as is shown in FIG. 8*a*, a locking pin 5*c*" is arranged essentially at an end portion of the pivot shaft 5*c*, wherein the locking pin protrude in a perpendicular direction in relation to the pivot axis 5*c*' to prevent accidental removal of the adjusting portion 5 from the first portion 4.

Figure 8B:
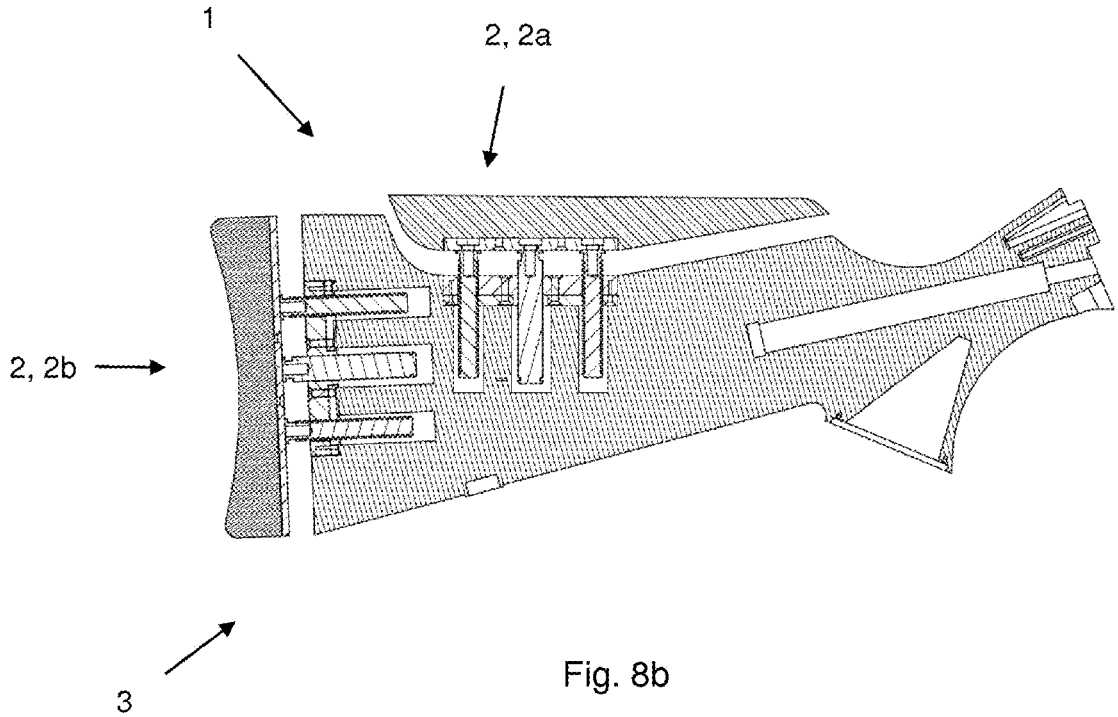
FIG. 8*b* is a cross-section of a rifle stock comprising an adjusting device according to the invention.

FIG. 8*b* is a cross-section of a rifle stock 3 comprising an adjusting device 1 according to one embodiment of the invention. In addition to the adjusting device 1 herein used for an adjustable cheek rest 2*a* as disclosed in FIG. 6*a*, the adjusting device 1 is herein also used for an adjustable shoulder rest 2*b*. Any embodiment described herein may be used for an adjustable shoulder rest 2*b*. The first portion 4 of the latter adjusting device is fixedly arranged in the rifle stock 3, and the adjusting portion 5 is fixedly arranged in the adjustable shoulder rest 2*b*. What is described in relation the mounting of the adjusting device 1 for an adjustable cheek rest 2*a*, may also be applied for the mounting of the adjustable device 1 for an adjustable shoulder rest 2*b*. According to one embodiment, the retaining device 5*d* is shaped to have essentially the same shape, i.e. concerning the outer boundary of the mounting surface of the same, as the adjustable shoulder rest 2*a* or adjustable cheek rest 2*b*.

According to one embodiment, a rest 2, 2*a*, 2*b* for a rifle stock 3 is provided comprising an adjusting device 1 according to any embodiment described.

According to one embodiment, a rifle is provided, comprising a rifle stock 3.

According to one embodiment, the first portion 4 and adjustable portion 5 are fixedly arranged to the rifle stock 3 and adjustable rest 2*a*, 2*b* by means of screws.

A preferred embodiment of an adjusting device 1 for an adjustable rest 2, 2*a*, 2*b* for a rifle stock 3, according to the invention has been described. However, the person skilled in the art realizes that this can be varied within the scope of the appended claims without departing from the inventive idea.

All the described alternative embodiments above or parts of an embodiment, can be freely combined without departing from the inventive idea as long as the combination is not contradictory.

The invention claimed is:

1. Adjusting device for an adjustable rest for a rifle stock, comprising:

a first portion adapted to be fixedly arranged to the rifle stock, an adjusting portion adapted to be releasably engaged with the first portion and rotationally movable around a pivot axis in relation to the first portion between an engaged, locking position and a disengaged, release position upon actuation of the adjusting portion, wherein the adjusting portion is adjustable in relation to the first portion in a direction parallel to the pivot axis in a release position, and wherein the adjusting portion is locked in the direction parallel to the pivot axis in relation to the first portion in the locking position, wherein the adjusting portion is adapted to be fixedly arranged to the adjustable rest.

2. The adjusting device according to claim 1, wherein a biasing device is adapted to force the adjusting portion towards the locking position.

3. The adjusting device according to claim 1, wherein the first portion comprises a first opening a second opening and a third opening, wherein the first opening and second opening comprises respective locking surfaces, wherein the adjusting portion comprises a first locking device comprising a locking surface, wherein the first locking device is adapted to be arranged in the first opening, and further adapted to releasably engage with the locking surface of the first opening, a second locking device comprising a locking surface wherein the second locking device is adapted to be arranged in the second opening, and further adapted to releasably engage with the locking surface of the second opening, a pivot shaft adapted to be slidingly and pivotally arranged in the third opening of the first portion, wherein the center axis of the pivot shaft forms a pivot axis, wherein the adjusting portion is biased in a locking position, wherein the adjusting portion is adapted to rotate around the pivot axis upon actuation of the adjusting portion, whereby the first locking device disengages from the locking surface of the first opening and the second locking device disengages from the locking surface of the second opening, whereby the adjusting portion moves towards the release position for enabling adjusting of the adjusting portion in relation to the first portion in a direction parallel to the pivot axis.

4. The adjusting device according to claim 1, wherein the first portion comprises a first opening and a second opening, wherein the first opening and second opening comprises respective locking surfaces, wherein the adjusting portion comprises a first locking device comprising a locking surface, wherein the first locking device is adapted to be arranged in the first opening, and further adapted to releasably engage with the locking surface of the first opening, a second locking device comprising a locking surface wherein the second locking device is adapted to be arranged in the second opening, and further adapted to releasably engage with the locking surface of the second opening, wherein the adjusting portion is biased in a locking position, wherein the adjusting portion is adapted to rotate around a pivot axis upon actuation of the adjusting portion, whereby the first locking device disengages from the locking surface of the first opening and the second locking device disengages from the locking surface of the second opening, whereby the adjusting portion moves towards the release position for enabling adjusting of the adjusting portion in relation to the first portion in a direction parallel to the pivot axis.

5. The adjusting device according to claim 1, wherein the first portion comprises a first opening and a second opening, wherein the first opening comprises a locking surface, wherein the adjusting portion comprises a first locking device comprising a locking surface, wherein the first locking device is adapted to be arranged in the first opening, and further adapted to releasably engage with the locking surface of the first opening, a second locking device comprising a locking surface wherein the second locking device is adapted to be arranged in the second opening, wherein the center axis of the second locking device forms a pivot axis wherein the adjusting portion is biased in a locking position by a biasing device, wherein the biasing device comprises a biasing portion and a first spring device, wherein the biasing portion is pivotally arranged on the first portion, wherein the biasing portion comprises a locking surface, wherein the second locking device is further adapted to releasably engage with the locking surface, wherein the adjusting portion is adapted to rotate around the pivot axis upon actuation of the adjusting portion, whereby the first locking device disengages from the locking surface of the first opening and the second locking device disengages from the locking surface of the biasing portion, whereby the adjusting portion moves towards the release position for enabling adjusting of the adjusting portion in relation to the first portion in a direction parallel to the pivot axis.

6. The adjusting device according to claim 1, wherein the adjusting portion further comprises a retaining device-, wherein the first locking device and second locking device and pivot shaft, is fixedly arranged in the retaining device.

7. The adjusting device according to claim 1, wherein the first opening and second opening are shaped to partially encompass the circumference of the first locking device and second locking device at a respective locking portion, wherein the locking portions comprises the locking surfaces of the first portion.

8. The adjusting device according to claim 1, wherein the first opening and second opening are shaped to enable the movement of the first locking device and second locking device in a release direction out of and away from the locking portions of the first and second openings, to a release position of the adjusting portion upon rotation of the adjusting portion around the pivot axis.

9. The adjusting device according to claim 1, wherein the first locking device and second locking device are elongatedly shaped to extend in a main extension direction, wherein the main direction is parallel to the pivot axis when the first and second locking devices and pivot shaft are arranged in the respective first opening-, second opening and third opening.

10. The adjusting device according claim 1, wherein the locking surfaces comprises locking teeth or grooves.

11. The adjusting device according to claim 10, wherein the locking teeth or grooves of the locking devices and the first and second openings are shaped as alternately increased and reduced radii portions adapted to matingly engage with each other, wherein the height of the radii portions in the main extension direction of the locking devices and holes, parallel to the pivot axis defines the adjusting steps of the adjusting device.

12. The adjusting device according to claim 11, wherein the radii of the locking teeth or grooves of the locking devices and/or the openings are shaped such that the adjusting portion requires a rotation of 1-10° around the pivot point, to move from a locking position to a release position.

13. The adjusting device according to claim 1, wherein the openings are through-holes.

14. The adjusting device according to claim 1, wherein the adjusting portion is biased towards a locking position by a biasing device comprising at least a first spring device arranged to press the first locking device and second locking device towards the locking surface of the first and second opening respectively.

15. A rifle stock comprising an adjusting device according to claim 1, wherein the first portion is fixedly arranged in the rifle stock and the adjusting portion is fixedly arranged in an adjustable cheek rest.

16. A rifle stock comprising an adjusting device according to claim 1, wherein the first portion is fixed in the rifle stock and the adjusting portion is fixedly arranged in an adjustable shoulder res.

17. A rest for a rifle stock comprising an adjusting device according to claim 1.

18. A rifle comprising a rifle stock according to claim 15.

* * * * *